US008746025B2

(12) United States Patent
Haviv et al.

(10) Patent No.: US 8,746,025 B2
(45) Date of Patent: Jun. 10, 2014

(54) KEY, LOCK AND LOCKING MECHANISM

(75) Inventors: Asher Haviv, Bat-Yam (IL); Eric Torgeman, Natania (IL)

(73) Assignees: Smarter Place Technologies Ltd., Ramat-Gan (IL); Eric Torgeman, Natania (IL)

( * ) Notice: Subject to any disclaimer, the term of this patent is extended or adjusted under 35 U.S.C. 154(b) by 91 days.

(21) Appl. No.: 12/995,468

(22) PCT Filed: Jun. 1, 2009

(86) PCT No.: PCT/IL2009/000540

§ 371 (c)(1), (2), (4) Date: Dec. 1, 2010

(87) PCT Pub. No.: WO2009/147660

PCT Pub. Date: Dec. 10, 2009

(65) Prior Publication Data

US 2011/0072867 A1 Mar. 31, 2011

(30) Foreign Application Priority Data

Jun. 1, 2008 (IL) ..... 191855

(51) Int. Cl.
*E05B 19/00* (2006.01)

(52) U.S. Cl.
USPC ..... 70/395; 70/398; 70/399; 70/402; 70/405; 70/406; 70/407; 70/409

(58) Field of Classification Search
USPC ..... 70/357, 402, 428, 336, 356, 494, 395, 70/398, 399, 405, 406, 409
See application file for complete search history.

(56) References Cited

U.S. PATENT DOCUMENTS 1,422,497 A 7/1922 Thompson
1,422,515 A 7/1922 Augenbraun (Continued)

FOREIGN PATENT DOCUMENTS

DE 3424307 1/1985
DE 3643188 6/1988

(Continued)

OTHER PUBLICATIONS

Response Dated Sep. 22, 2011 to Official Action of Aug. 22, 2011 From the US Patent and Trademark Office Re. U.S. Appl. No. 12/995,676.

(Continued)

*Primary Examiner* — Suzanne Barrett
*Assistant Examiner* — Myles Throop

(57) ABSTRACT

A key blank comprises a shaft and a head connected to the shaft, the shaft including first and second surface that are oppositely facing, wherein the surfaces are configured to include combination elements to operate a lock and a pair of coaxial operating elements, wherein one element of the pair is operative from the first surface of the shaft and the other element of the pair is operative from the second surface of the shaft, and wherein at least one of the operative elements is a resilient element mounted inside a bore provided in the shaft, wherein the resilient element is operative to exert a compressive force on a pin mechanism of the lock in response to the operative engagement and thereby release the pin mechanism from a lock position, without requiring any pressure on the coaxial element on the other side.

29 Claims, 13 Drawing Sheets

(56) References Cited

U.S. PATENT DOCUMENTS

| | | | | | |
|---|---|---|---|---|---|
| 3,780,549 | A | | 12/1973 | Schlage | |
| 4,377,082 | A | | 3/1983 | Wolter | |
| 5,123,268 | A | * | 6/1992 | Eizen | 70/359 |
| 5,170,651 | A | | 12/1992 | Errani | |
| 5,437,176 | A | * | 8/1995 | Keller | 70/358 |
| 5,520,035 | A | * | 5/1996 | Eizen et al. | 70/358 |
| 5,704,234 | A | | 1/1998 | Resch | |
| 5,711,506 | A | | 1/1998 | Stillwagon | |
| 5,784,910 | A | * | 7/1998 | Eizen et al. | 70/395 |
| 5,839,308 | A | * | 11/1998 | Eizen et al. | 70/358 |
| 5,970,760 | A | | 10/1999 | Shen | |
| 6,508,091 | B1 | * | 1/2003 | Donatini | 70/359 |
| 7,003,994 | B2 | | 2/2006 | Ruan | |
| 7,181,938 | B2 | | 2/2007 | Price | |
| 7,647,799 | B2 | * | 1/2010 | Markbreit et al. | 70/409 |
| 8,336,350 | B2 | * | 12/2012 | Nicoara | 70/395 |
| 8,387,425 | B2 | * | 3/2013 | Ben-Aharon et al. | 70/405 |
| 2003/0089148 | A1 | | 5/2003 | Ruan | |
| 2005/0275535 | A1 | * | 12/2005 | Hsieh | 340/542 |
| 2010/0024499 | A1 | | 2/2010 | Xu et al. | |
| 2011/0048084 | A1 | * | 3/2011 | Tong | 70/491 |
| 2011/0072867 | A1 | | 3/2011 | Haviv et al. | |
| 2011/0072868 | A1 | * | 3/2011 | Haviv et al. | 70/357 |
| 2013/0091911 | A1 | * | 4/2013 | Dolev | 70/493 |

FOREIGN PATENT DOCUMENTS

| | | |
|---|---|---|
| DE | 4317994 | 10/1994 |
| DE | 29602680 | 4/1996 |
| EP | 0161654 | 11/1985 |
| EP | 0237799 | 9/1987 |
| FR | 2378925 | 8/1978 |
| GB | 2298454 | 9/1996 |
| WO | WO 2005/095738 | 10/2005 |
| WO | WO 2008/015672 | 2/2008 |
| WO | WO 2009/147660 | 12/2009 |
| WO | WO 2009/147677 | 12/2009 |

OTHER PUBLICATIONS

Official Action Dated Aug. 22, 2011 From the US Patent and Trademark Office Re. U.S. Appl. No. 12/995,676.

Notice of Allowance Dated May 11, 2012 From the US Patent and Trademark Office Re. U.S. Appl. No. 12/995,676.

Response Dated Nov. 2, 2011 to Communication Pursuant to Article 94(3) EPC of May 2, 2011 From the European Patent Office Re. Application No. 09758021.1.

Official Action Dated Nov. 17, 2011 From the US Patent and Trademark Office Re. U.S. Appl. No. 12/995,676.

International Preliminary Report on Patentability Dated Sep. 8, 2010 From the International Preliminary Examining Authority Re. Application No. PCT/IL2009/000540.

International Preliminary Report on Patentability Dated Jul. 30, 2010 From the International Preliminary Examining Authority Re. Application No. PCT/IL2009/000560.

International Search Report and the Written Opinion Dated Sep. 18, 2009 From the International Searching Authority Re.: Application No. PCT/IL2009/000560.

International Search Report and the Written Opinion Dated Dec. 21, 2009 From the International Searching Authority Re.: Application No. PCT/IL2009/000540.

Response Dated Apr. 7, 2010 to Written Opinion of Sep. 18, 2009 From the International Searching Authority Re.: Application No. PCT/IL2009/000560.

Response Dated Mar. 31, 2010 to International Search Report and the Written Opinion of Dec. 21, 2009 From the International Searching Authority Re.: Application No. PCT/IL2009/000540.

Communication Pursuant to Article 94(3) EPC Dated May 2, 2011 From the European Patent Office Re. Application No. 09758021.1.

Office Action Dated Mar. 22, 2011 From the Israel Patent Office Re. Application No. 191855 and Its Translation Into English.

Translation of Office Action Dated Dec. 5, 2012 From the State Intellectual Property Office of the People's Republic of China Re. Application No. 200980129935.7.

Translation of Search Report Dated Dec. 5, 2012 From the State Intellectual Property Office of the People's Republic of China Re. Application No. 200980129935.7.

Communication Pursuant to Article 94(3) EPC Dated May 6, 2013 From the European Patent Office Re. Application No. 09758004.7.

Office Action Dated Oct. 22, 2013 From the State Intellectual Property Office of the People's Republic of China Re. Application No. 200980129935.7 and Its Translation Into English.

* cited by examiner

KEY, LOCK AND LOCKING MECHANISM

RELATED APPLICATIONS

This Application is a National Phase of PCT Patent Application No. PCT/IL2009/000540 having International filing date of Jun. 1, 2009, which claims the benefit of Israel Patent Application No. 191855 filed on Jun. 1, 2008. The contents of the above Applications are all incorporated herein by reference.

FIELD OF THE INVENTION

The present invention, in some embodiments thereof, relates to locking mechanisms and, more particularly, but not exclusively, to key blanks for use with cylinder locks.

BACKGROUND OF THE INVENTION

Generally a key for a cylinder lock comprises an elongated shaft that has a combination portion operative to engage one or more pin mechanisms within a plug of the cylinder. The pin mechanisms in the lock typically serve to obstruct rotation of the plug when locked. The combination portion on the shaft includes varying cuts and/or indentations, in a unique combination that matches corresponding pins in the matching cylinder lock. When a matching key is inserted inside a keyway of a plug of the cylinder lock, a shear line of the plug is freed so that the key may be turned to lock or unlock the cylinder lock. By providing different combinations of key features, key manufacturers are capable of supplying many different locks and matching keys that are uniquely associated and therefore not interchangeable, thus preventing opening a lock with a key that is not originally designed for the same lock. More recently, the option of adding resilient protrusions with pre-defined heights to the combination portion of keys and corresponding pins to the cylinder lock has been provided.

Israel Patent Publication No. IL137053 entitled "Locking System" assigned to Asher Haviv, the contents of which is incorporated herein by reference, describes a key blank including a first and second push-pin positioned on opposite surfaces of a key shaft and equally offset from a centerline of the combination surface. The push pins are under pressure from within the key shaft to extend outwardly from their respective surfaces. The push-pins can be pushed into a keyway of a lock with applied force and are operable to displace at least one lock pin that extends into a rotatable plug of the lock and to release the shear line of the plug so that the plug can be rotated. When the key is inserted into the lock, the push-pins are pushed into the key so that the key can pass into the keyway.

U.S. Patent Publication No. 2008/0236223 entitled "Key Combination element in Key Blank and Key", the contents of which is incorporated herein by reference, describes a resilient element disposed through a bore in a shaft of a key blank so that it protrudes from both surfaces of the shaft. In operation, when inserted into a keyway of a lock, one protruding end of the element applies an urging force to unlock a lock combination element in response to the other end being pushed inward by a wall in the keyway.

U.S. Pat. No. 5,839,308 entitled "Locking Apparatus", the contents of which is incorporated herein by reference, describes a key blank including a movable pin element retained within a shaft of the key blank. The movable pin element is operable to be displaceable in a single direction, outwardly from the key combination surface. When inserted into a corresponding lock, a spring loaded pin housed within a plug of the lock urges the movable pin element on the key shaft into operative engagement with a another a pin assembly on an opposite side of the shaft so that shear line of the plug is released and the plug is allowed to rotate.

International Patent Application Publication No. WO/0057006 entitled "Key blank and resiliently protruding pins", the contents of which is incorporated herein by reference, describes a key blank with at least one resiliently protruding pin element on a shaft of the key that partially protrudes from a surface of the shaft while no external forces are applied on the protruding pin and retracts inwardly into a cavity in response to an external force exerted on it. In operation, the resiliently protruding pin actuates an internal mechanism provided within a lock.

United Kingdom Patent Application No. 2,161,204 entitled "A key for a lock", the contents of which is incorporated herein by reference, describes a pair of aligned moving bodies positioned in opposite edges of a shaft of a key. A dedicated spring acts on each of the moving bodies to cause a head of the body to protrude beyond the shaft. The key is used with a lock provided with locking pins that are driven by the moving bodies into an unlock position.

SUMMARY OF THE INVENTION

According to an aspect of some embodiments of the present invention there is provided a key blank including a first and second operating element positioned on opposite surfaces of a key shaft such that the opposite facing operating elements are coaxially aligned.

An aspect of some embodiments of the present invention provides for a key blank comprising: a shaft and a head connected to the shaft, the shaft including first and second surface that are oppositely facing, wherein the surfaces are configured to include combination elements to operate a lock; a pair of coaxial operating elements, wherein one element of the pair is operative from the first surface of the shaft and the other element of the pair is operative from the second surface of the shaft; and wherein at least one of the operative elements is a resilient element mounted inside a bore provided in the shaft, wherein the resilient element is operative to exert a compressive force on a pin mechanism of the lock in response to the operative engagement and thereby release the pin mechanism from a lock position, without requiring any pressure on the coaxial element on the other side.

Optionally, the bore is a through going bore and both elements of the pair of coaxial operating elements are mounted in same bore.

Optionally, the at least one resilient element partially protrudes from one of the first and second surface of the shaft while no force is exerted on it.

Optionally, both elements of the pair are resilient elements.

Optionally, both the elements of the pair are spring loaded with a common spring element.

Optionally, the elements are telescopic with respect to each other.

Optionally, the pair of coaxial operating elements is centered along a width of the first and second surface of the shaft.

Optionally, the pair of coaxial operating elements is centered with respect to central axis of a matching lock.

Optionally, at least one of the operating elements of the pair includes a indentation operative to operatively engage a pin mechanism of the lock to release the pin mechanism from a locked position.

Optionally, the operating elements of the pair are different in size shape or both.

Optionally, the pair of coaxial operating elements is prepackaged in capsule form.

Optionally, the coaxial pair of operating elements on the key blank provides for a reversible key blank.

Optionally, the axis common to the pair of coaxial operating elements is perpendicular to the first and second surface of the shaft.

Optionally, the key blank comprises two pairs of coaxial operating elements.

Optionally, the two pairs of coaxial operating elements are aligned along an axis crossing a width of the shaft.

Optionally, the two pairs of coaxial operating elements are positioned to provide reversibility of the key blank.

Optionally, the two pairs of coaxial operating elements are operative to engage four different pin mechanisms in the lock.

An aspect of some embodiments of the present invention provides for a method of manufacturing a key blank, the method comprising: forming a through going bore through a shaft of a key blank; positioning a pair of coaxial operating elements into the through going bore, wherein each operating element of the pair is configured to operate without requiring any pressure on the coaxial element on the other side; and retaining at least a portion of the pair of coaxial operating elements within the shaft.

Optionally, at least one element of the pair is operable to change from a partially protruding position to a depressed position in response to exertion of a compressive force on the at least one element while retained in the bore.

Optionally, them method comprises positioning a spring element between the pair of coaxial operating elements.

Optionally, at least one element of the pair is operable to exert an operative force on a key pin of a matching lock without requiring that a compressive force be exerted on the other element of the pair.

Optionally, the method comprises retaining the pair of coaxial operating elements with a sealing ring positioned around one of the pair of coaxial operating elements.

Optionally, the pair of coaxial operating elements is prepackaged in capsule form.

An aspect of some embodiments of the present invention provides for a key cylinder lock operable by the key blank, the lock comprising: a housing; a plug disposed within the housing configured for rotation relative thereto and defining a keyway and a circumferential shear line; and at least one spring loaded pin mechanism extending from the housing through the plug so as to obstruct the shear line, wherein the pin mechanism is operative to clear the shear line in response to operative engagement with at least one operative element of the pair of coaxial operative elements without requiring any pressure on the other coaxial element of the pair.

Optionally, the compressive force exerted by the at least one operative element is greater than the spring loaded force of the pin mechanism included in the lock.

Optionally, the lock includes two oppositely facing spring loaded pin mechanisms, each extending from the housing through the plug from opposite directions so as to obstruct the shear line, wherein each of the two pin mechanisms is operative to clear the shear line in response to operative engagement with each operative element of the pair.

Optionally, the pin mechanism includes a key pin and a driving pin in operative engagement, and wherein at least a portion of the key pin is centered with respect to the keyway and the driving pin is centered with respect to the housing.

Optionally, the at least one resilient operating element of the key blank is operative to push the key pin from a position within the keyway of the lock to a position out of the keyway of the lock.

Optionally, at least a portion of the key pin is centered with respect to the keyway.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
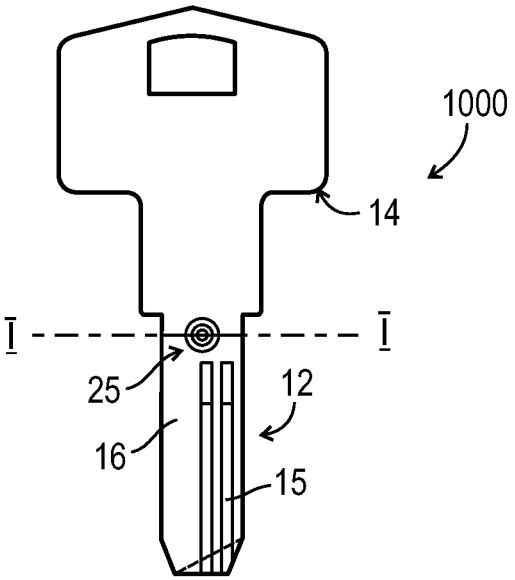
FIGS. 1A-1D are schematic illustrations of exemplary key blanks, each including a coaxial pair of operative elements in accordance with some embodiments of the present invention.

The present invention, in some embodiments thereof, relates to locking mechanisms and, more particularly, but not exclusively, to key blanks for use with cylinder locks.

An aspect of some embodiments of the present inventions provides for key blank including two operating key elements positioned on opposite surfaces of a key shaft so that the two operating key element are coaxial. According to some embodiments of the present invention, at least one of the coaxial operating elements is constructed from a resilient material and/or is a spring loaded element. Optionally, the other coaxial operating element is not resilient (or spring loaded) and provides an indentation on a surface of a shaft having a pre-defined shape, size and depth matching a locking pin mechanism in a corresponding lock. According to some embodiments of the present invention, the at least one resilient or spring loaded element protrudes from a surface of the shaft while no external forces are applied on the element and retracts inwardly into a cavity in response to an external force exerted on it. According to some embodiments of the present invention, each of the coaxial operating elements is operative to operate a different locking pin mechanism of a matching lock.

According to some embodiments of the present invention, both of the coaxial elements are resilient and/or spring loaded and are operative to protrude from opposite surfaces of the shaft while no external forces are applied on the elements and each of the operating elements retracts inwardly into a cavity in response to an external force exerted on it. Typically, the cavity is a common to both elements. Typically, if each of the coaxial elements is spring loaded, a common spring element is used to provide resilient properties to both the elements.

In some exemplary embodiments, the coaxial operative elements are centered along a latitudinal axis of the key shaft surface. Optionally, the coaxial operative elements are identical to each other and thereby provide for a reversible key. Alternatively, each of these coaxial operating elements is different, e.g. different in shape and size.

In some exemplary embodiments, a key shaft is provided with a plurality of coaxial pairs of operating elements, e.g. two pairs. Optionally, the coaxial pairs are symmetrically offset from each other along the width of the shaft so that the key may be reversible. Optionally, the operative elements on a common surface of the shaft are different but operative elements from different pairs and on different sides of the shaft are identical so that the key may be reversible. Alternatively, the coaxial elements are all different and suitable for providing more combinations for a non-reversible key blank. Optionally, a key shaft is provided with a plurality of coaxial pairs of operating elements offset from each other in a longitudinal axis of the key blank. This key is also reversible.

The present inventors have found that providing two operating elements along a single axis provides for increasing the number of combinations possible for resilient operating elements over a surface area of a key shaft. Typically, the space provided on the key shaft as well as in the corresponding cylinder lock is limited. Providing operating elements on opposite surfaces of the key shaft (and on opposing sides of a key way of a lock) provides for increasing the number of locking pin mechanisms that can be concurrently used to lock the lock.

According to some embodiments of the present invention, a key blank, including coaxial operating key elements is manufactured by making a through hole (a through going bore) into a key blank and then inserting and retaining the operative elements within the through hole. Optionally, the coaxial operating elements are pre-assembled in the form of a capsule prior to being inserted and retained into the key shaft, e.g. the through hole made on the key shaft. The present inventors have found that from a manufacturing point of view introducing resilient operating elements into a through hole may be preferable to embedding such elements into a blind hole. Typically, making a through hole on a key shaft is both easier and cheaper than making a blind hole and the through hole provides positioning the coaxial operating elements with greater accuracy since tolerances typically associated with the dimensions of the blind hole do not come into play. Additionally, coaxial elements assembled within a through hole provide for using a common cavity to contain two operative elements and/or a common spring element to spring load two operative elements. As such the unit is cheaper as compared to operative elements assembled in two separate blind holes.

According to some embodiments of the present invention, at least one of the spring loaded operative elements is operative to exert a force on a locking pin so as to release a shear line of the lock. Typically, the exerted force is operative to push out a pin that protrudes into the plug and thereby free the shear line of the plug. Typically, the coaxial elements provided on a key shaft co-exist with other indentations and/or cuts on the key shaft operative to passively engage with additional locking pin mechanisms in the lock. Typically, such indentation and/or cuts provide for receiving spring loaded pins that otherwise protrude out from the plug. The present inventors have found that the difficulty in picking a lock associated with such a key is significantly increased when the lock includes two oppositely facing locking pin mechanisms that are required to be pushed away from the volume defined by the keyway in order to clear the shear line of the plug and allow rotation.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 1B:
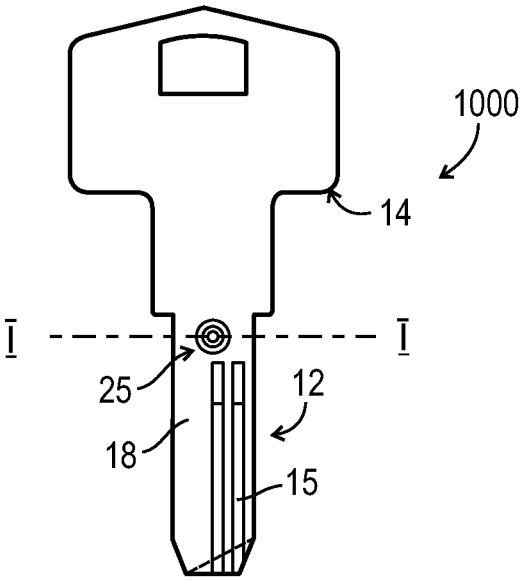
Figure 1C:
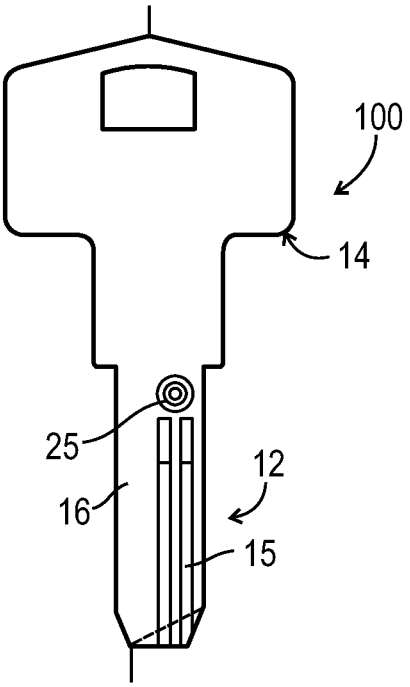
Figure 1D:
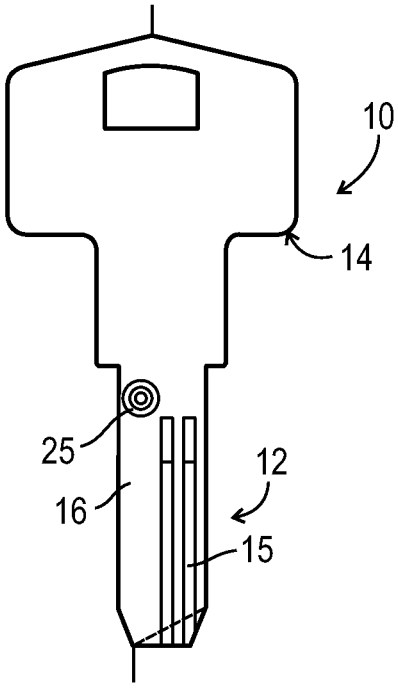

Reference is now to FIGS. 1A-1D showing schematic illustrations of exemplary key blanks, each including a coaxial pair of operative elements, in accordance with some embodiments of the present invention. Exemplary keys 10, 100, and 1000 are structured with a key head 14 from which an elongated shaft 12 is extended. Shaft 12 may optionally include one or more grooves 15 engraved on at least one surface 16 of shaft 12 that match engravings on a keyway of a matching lock. Optionally, grooves similar to grooves 15 are also present on a surface 18 of the shaft 12 opposite surface 16 so that the key can be reversible (FIG. 1B). Typically, shaft 12 additionally includes various cuts and/or indentation (not shown) operative to engage one or more pin mechanisms within a plug of a matching cylinder. The various cuts and/or indentation may be present on surface 16 or on both surfaces 16 and 18 of shaft 12.

According to some embodiments of the present invention, shaft 12 additionally includes a coaxial pair of operating elements 25 extending from one surface 16 of shaft 12 to opposite surface 18 of shaft 12. According to some embodiments of the present invention, at least one of the coaxial pair of operating elements 25 is a resiliently protruding pin. Typically, each operative element of coaxial pair 25 is operative to operatively engage a different locking pin mechanism in a matching locking and thereby unlock the lock and/or an element of the lock. Optionally, the key is reversible and only one element of coaxial pair 25 at a time operatively engages a pin mechanism. When the key is reversed, the other element of the coaxial pair 25 operatively engages the pin mechanism of the lock. Typically, unlocking of a matching lock is provided in response to operative engagement of the coaxial pair 25 with the matching lock as well as operative engagement of other cuts and/or indentations with the matching lock.

In some exemplary embodiments, as in key 100, coaxial pair of operative elements 25 is positioned so as to be aligned with a central axis of a matching cylinder lock. This may provide for positioning the matching locking pin mechanisms along a central axis of the matching lock. In some exemplary embodiments, as in key 1000, reversibility is provided by a single coaxial pair 25, by centering the pair along a width of shaft 12. Optionally, as in key 10, the coaxial pair 25 is positioned at an arbitrary position along the width of shaft 12 and key 10 is not reversible.

Reference is now made to FIGS. 2A-2E showing an enlarged cross-sectional schematic views of exemplary coaxial pairs of operative elements along line I-I of FIG. 1A in accordance with some embodiments of the present invention. According to some embodiments of the present invention, coaxial pair 25 includes two back to back operative elements, e.g. operative elements 200-204 or 222 operative from each of surface 16 and surface 18. According to some embodiments of the present invention, at least one of the operative elements protrudes from a surface of shaft 12 and is spring loaded, e.g. with a spring 210 embedded within the shaft. It is noted that although spring element 210 is shown as a coil spring, other spring elements may be used, e.g. leaf springs. Protruding operative elements 200-204 are movable and are operative to slide and/or be depressed into the shaft if there is no (or low) compressive force exerted on the elements and to protrude from a surface of the shaft in response to no compressive force exerted on the elements. Optionally, each operative element is operable independently and/or without requiring any pressure on the coaxial element on the opposite side.

According to some embodiments of the present invention, the coaxial pair of elements may have unique geometries that are operative to match a dedicated pin mechanism of a matching lock for operating the lock. Optionally, each of coaxial pairs of elements 200A and 200B may have a similar geometry as in FIG. 2A providing for reversibility of the key. According to some embodiments of the present invention, when both operative elements of the pair are spring loaded, a single spring element 210 is operative to provide resilient properties to both the coaxial elements. Optionally, each of the spring loaded elements can operate independently of the other, irrespective of whether the other is protruding or not.

Figure 2A:
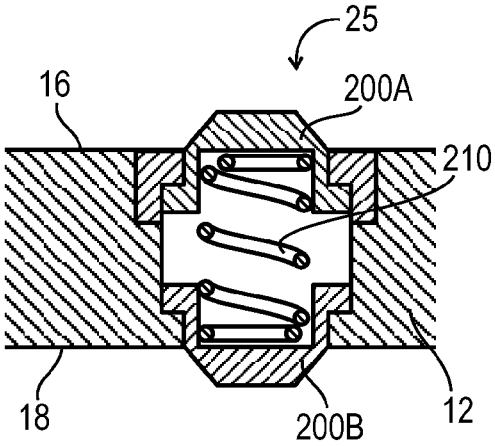
FIGS. 2A-2E are enlarged cross-sectional schematic views of exemplary coaxial pairs of operative elements along line I-I of FIG. 1A in accordance with some embodiments of the present invention.
Figure 2B:
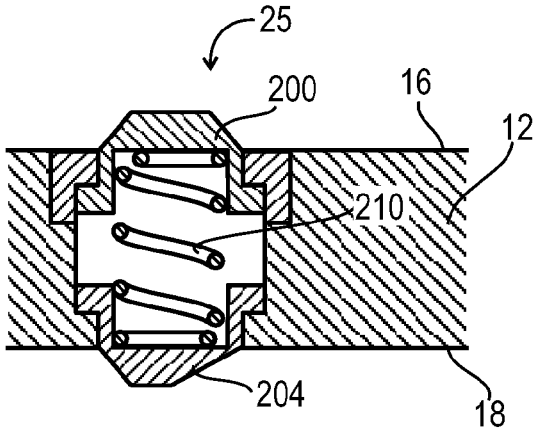
Figure 2C:
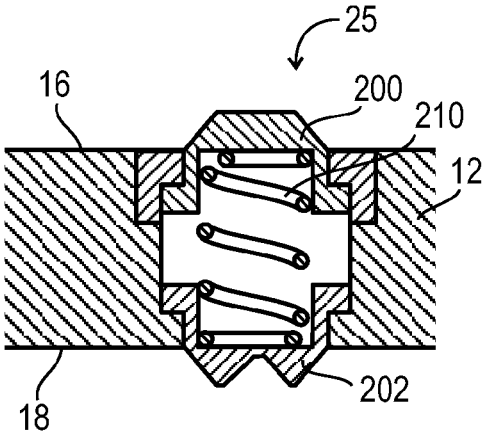
Figure 2D:
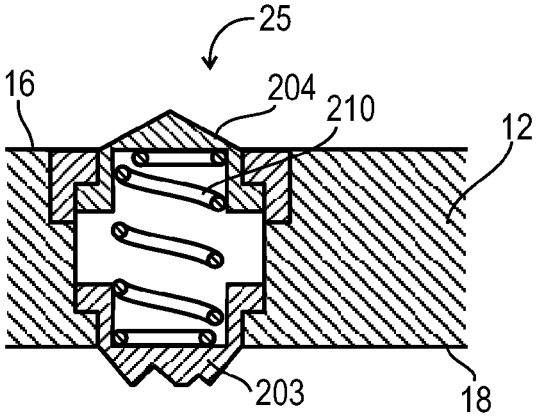
Figure 2E:
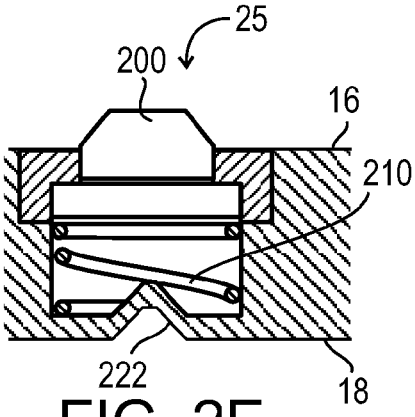

Optionally, operative elements, e.g. operative elements 203, include more than one groove operative to engage more than one pin in a matching lock. In some exemplary embodiments, only one of the coaxial pair of elements is spring loaded as shown in FIG. 2E and the other element is a static operative element 222 including an indentation and/or groove cut for operating a dedicated pin mechanism within a matching lock.

Figure 3:
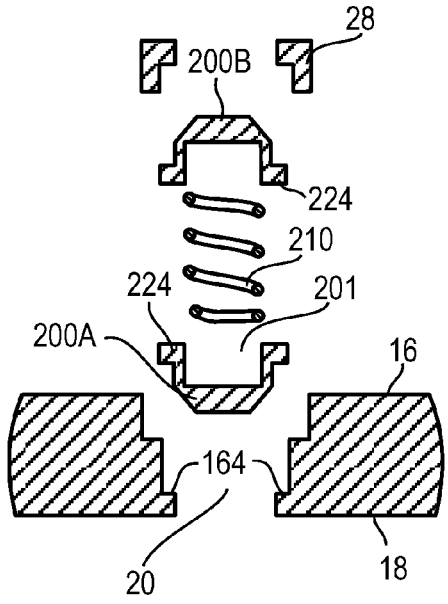
FIG. 3 is a schematic illustration showing an exemplary assembly of a coaxial pair of operative elements onto a key blank in accordance with some embodiments of the present invention.
Figure 4A:
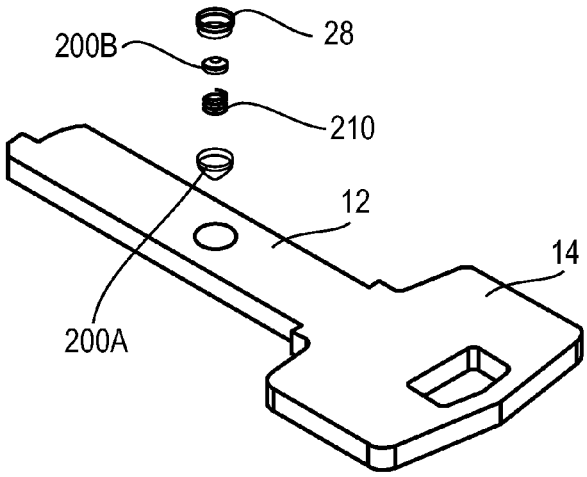
FIGS. 4A and 4B is a schematic illustration showing another exemplary assembly of a coaxial pair of operative elements onto a key blank in accordance with some embodiments of the present invention.
Figure 4B:
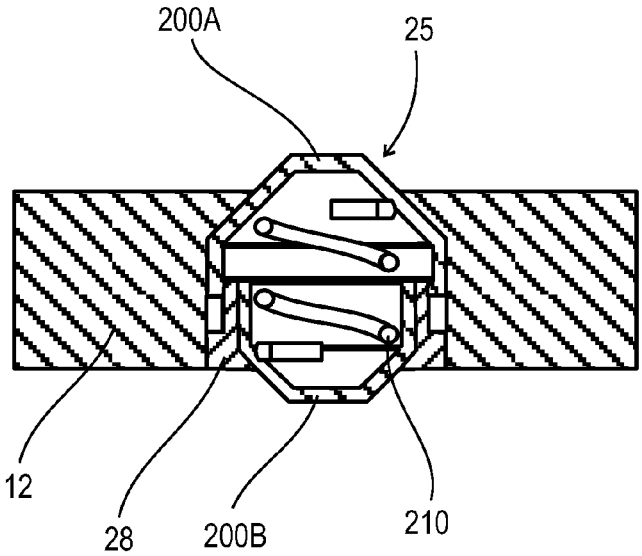

Reference is now made to FIG. 3 and FIG. 4A-4B showing two exemplary for assemblies of a coaxial pair of operative elements onto a key blank in accordance with some embodiments of the present invention. According to some embodiments of the present invention, a through-going bore is provided through shaft 12 from one surface 16 of the shaft to an opposite surface 18 of shaft 12. Optionally, bore 20 may have a varying diameter. Optionally, bore 20 is introduced while leaving a step 164 on which an operative element 200A is retained. It is noted that bore 20 may have a circular cross section or other cross section, e.g. rectangular cross section.

As shown in FIG. 3, in some exemplary embodiments, a first operative element 200A including a flange 224 is inserted through bore 20 and retained over step 164. A spring 210 is then inserted into a cavity 201 of operative element 200A and is capped with an additional operative element 200B. Optionally, a retaining element 28, e.g. a sealing ring around operative element 200B, is positioned to retain or seal operative element 200B within bore 20 of shaft 12. Optionally, a seal is not used and surface 16 is deformed by knocking surface 16 a two or more points around the bore 20, e.g. to create a step similar to step 164, so that flange 224 is retaining within bore 20. Operating elements may be manufactured by forging milling or molding.

According to some embodiments of the present invention, as shown in FIGS. 4A and 4B, operative elements 200A and 200B are telescopic elements and sealing element 28 provides a surface along which operative element 200B can slide against within a volume defined by operative element 200A. Typically, a common spring 210 is used to spring load each of operative elements 200A and 200B.

Figure 5A:
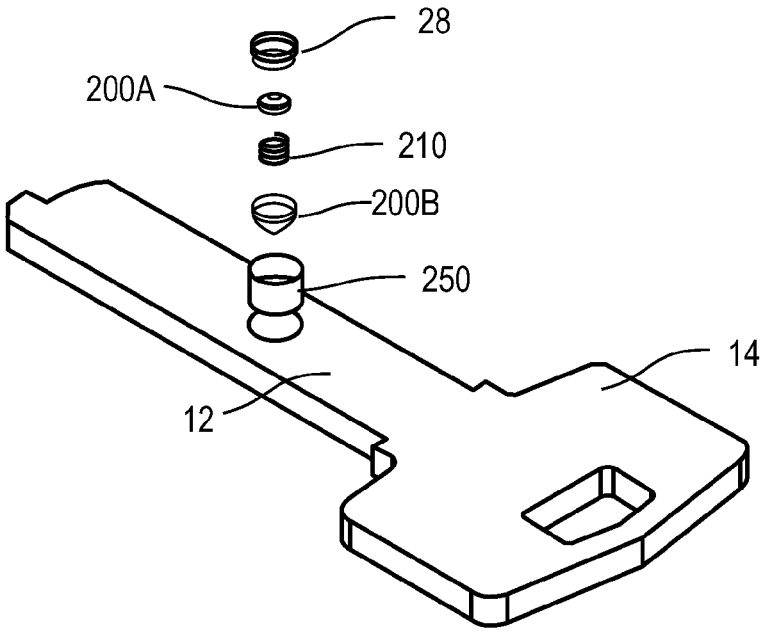
FIGS. 5A and 5B is a schematic illustration showing an exemplary assembly of a capsule including a coaxial pair of operative elements onto a key blank in accordance with some embodiments of the present invention.
Figure 5B:
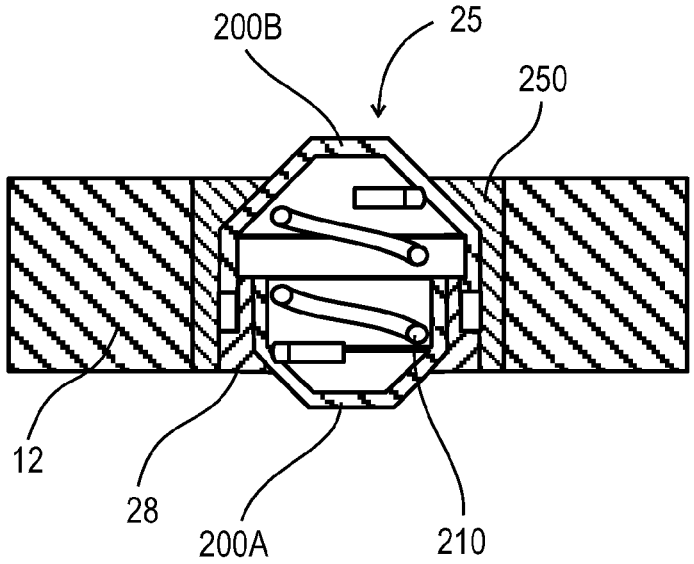

Reference is now made to FIGS. 5A and 5B showing an exemplary assembly of a capsule including a coaxial pair of operative elements onto a key blank in accordance with some embodiments of the present invention. According to some embodiments of the present invention, the coaxial pair of elements are pre-assembled in capsule 250 and inserted into bore 20. Optionally, operative elements 200A and 200B are telescopic. Optionally, operative elements 200B is movable in response to a compressive force and operative to slide along an inner wall of capsule 250. Typically, capsule 250 is tapered so as to retain operative element 200B within its walls. Likewise operative element 200A is also movable in response to a compressive force and is operable to slide along an inner wall of sealing element 28. Sealing element 28 is at least partially fitted inside of capsule 250 and is operative to seal and/or retail operative elements 200A and 200B and spring element 210 within capsule 250. Although, capsule 250 is shown as including two oppositely facing resilient operating elements, it is noted that in some exemplary embodiments capsule 250 may include one resiliently protruding operative element that is movable with respect to capsule 250 and one static operative element including an indented surface, e.g. similar to coaxial operative pair shown in FIG. 2E that is not moveable with respect to capsule 250.

Figure 6A:
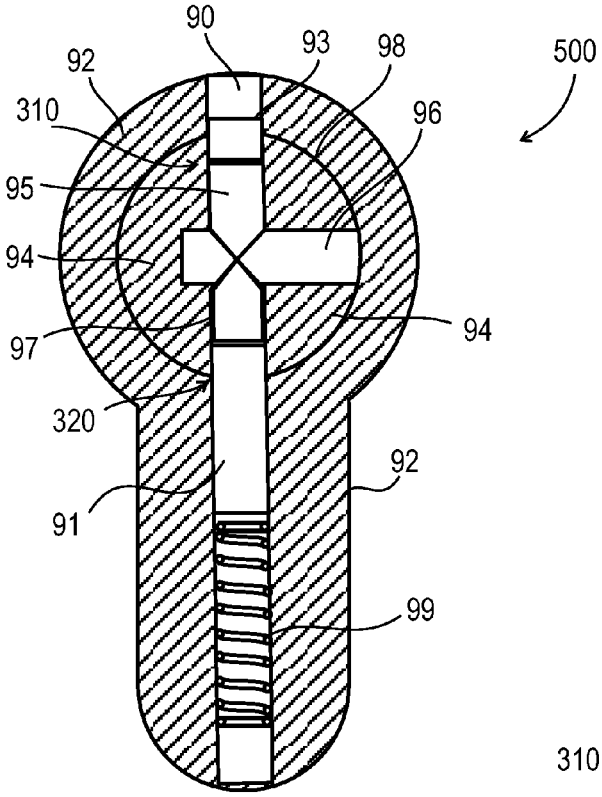
FIGS. 6A and 6B is a cross-sectional schematic view of an exemplary cylinder lock suitable for operational engagement with a coaxial pair of operative elements where both elements of the pair are resilient, shown in a locked position with no key and while engaging with the operative elements in accordance with some embodiments of the present invention.
Figure 6B:
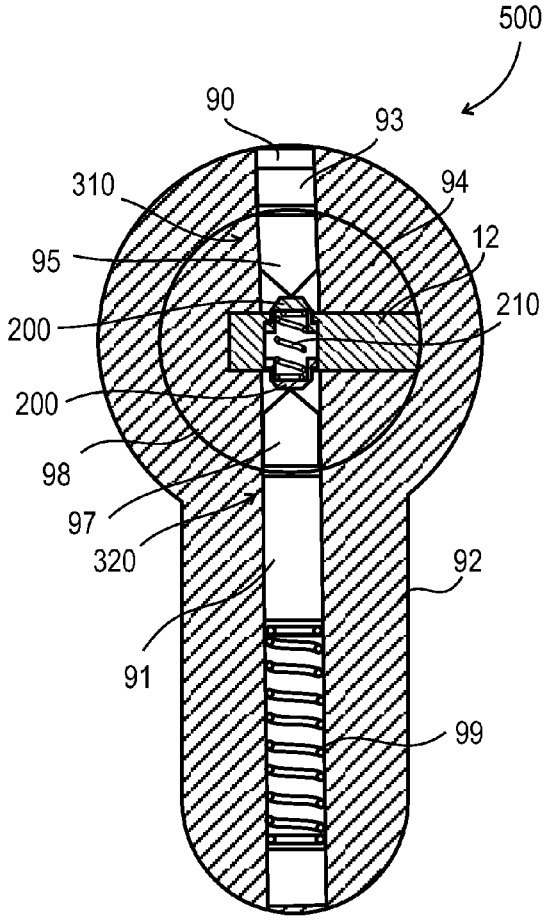

Reference is now made to FIGS. 6A and 6B showing a cross-sectional schematic view of an exemplary cylinder lock suitable for operational engagement with a coaxial pair of operative elements where both elements of the pair are resilient, shown in a locked position with no key and while engaging with the operative elements in accordance with some embodiments of the present invention. The cylinder lock typically includes a housing 92 including a rotatable plug 94 that rotates along shear line 98. The plug 94 typically includes a keyway 90 into which a key is inserted for locking and unlocking the lock. According to some embodiments of the present invention a cylinder lock 500 includes two oppositely facing pin mechanisms generally positioned perpendicularly from the path created by keyway 96 for a key shaft. In some exemplary embodiments, a first pin mechanism 310 includes a key pin 95 driven by a driving pin 93 and spring element 90 embedded in housing 92. Similarly, the second pin mechanism 320 includes a key pin 97 driven by a driver pin 91 and spring element 99.

According to some embodiments of the present invention, while cylinder 500 is in a locked state and no key is present within keyway 96, key pins 95 and 97 protrude within keyway 96 and driving pins 91 and 93 protrude within plug 94 so that the shear line 96 of plug 94 is prevented from rotating. According to some embodiments of the present invention, in response to a key shaft 12, e.g. key shaft of key 1000 with coaxial elements that match lock 500 being inserted into keyway 96, spring 210 or a corresponding resilient force is operative to overcome spring forces introduced by spring 99 and 93 and operative elements 200 push key pins out of keyway 96 which in turn serve to push driver pins 93 and 91 out of plug. According to some embodiments of the present invention, the size and shape of each operative element is configured for displacing key pins 95 and 97 a pre-determined distance to allow the key pins and driving pins to meet at shear line 98 so that rotation is not obstructed by either the key pins 95 and 97 or the driver pins 93 and 91. The present inventors have found that, by varying the size and shape of operative elements 200, a plurality of unique key-lock combinations can be provided.

Figure 7A:
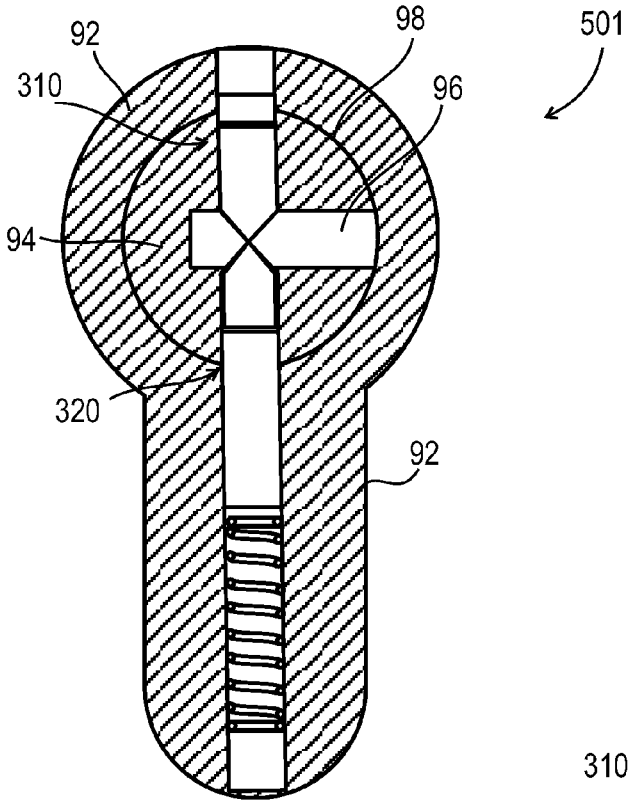
FIGS. 7A and 7B is a cross-sectional schematic view of an exemplary cylinder lock suitable for operational engagement with a coaxial pair of operative elements where only one element in the pair is a resilient element, shown in a locked position with no key and while engaging with the operative elements in accordance with some embodiments of the present invention.
Figure 7B:
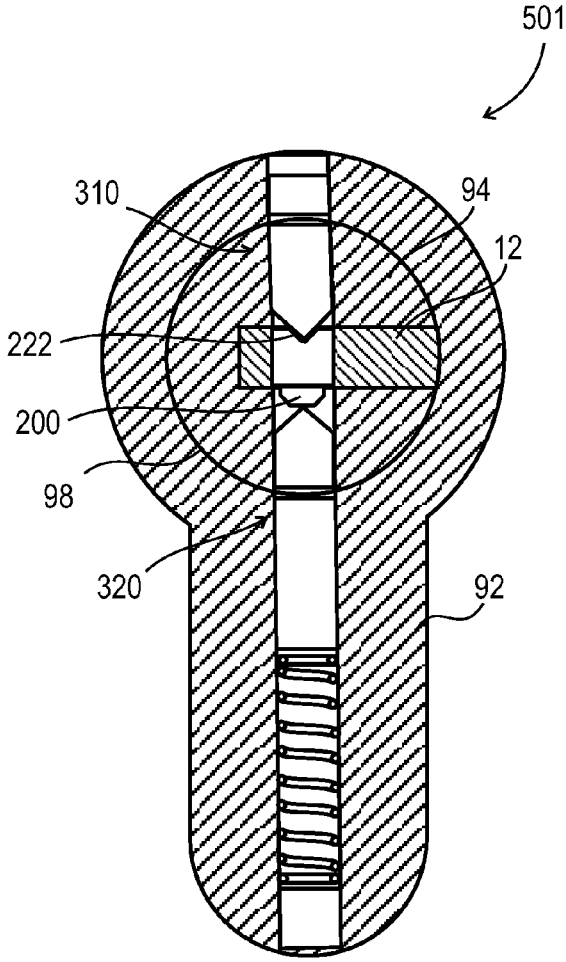

FIGS. 7A and 7B show a cross-sectional schematic view of an exemplary cylinder lock suitable for operational engagement with a coaxial pair of operative elements where only one element in the pair is a resilient element, shown in a locked position with no key and while engaging with the operative elements in accordance with some embodiments of the present invention. In such an exemplary embodiments, a predefined shape and size of an operative element 222 provides for displacing key pin 95A of a lock 501 a pre-defined distance so that drive pin 93 clears plug 94 and shear line 98 is cleared.

Figure 8:
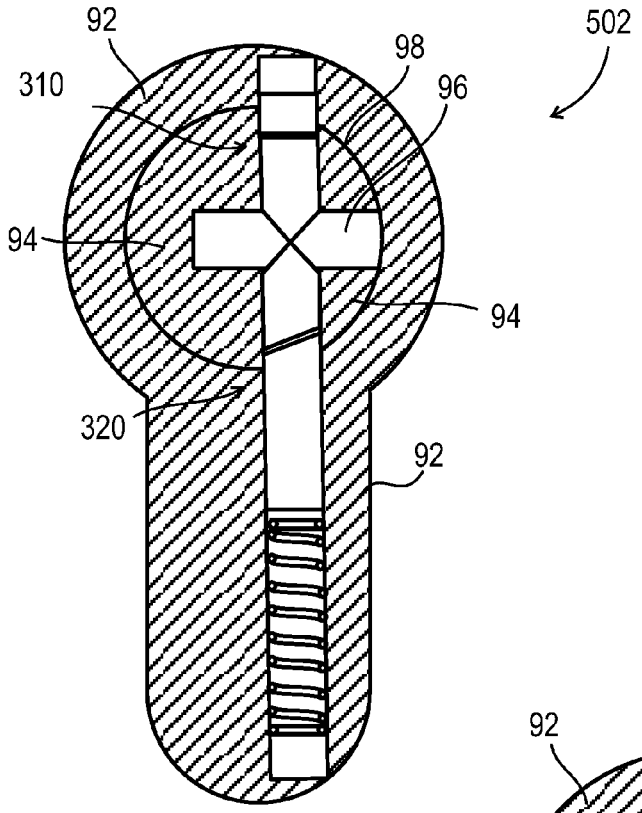
FIG. 8 is a cross-sectional schematic view of an exemplary cylinder lock suitable for operational engagement with a coaxial pair of operative elements centered on a key shaft, shown in a locked position with no key in accordance with some embodiments of the present invention.

FIG. 8 shows a cross-sectional schematic view of an exemplary cylinder lock suitable for operational engagement with a coaxial pair of operative elements centered on a key shaft 12, shown in a locked position with no key in accordance with some embodiments of the present invention. In some exemplary embodiments, pin mechanisms 310 and 320 in a lock 502 are positioned off centered with respect to housing 92 so as to be aligned with a coaxial pair of operating elements 25 centered along keyway 96. Typically, such an arrangement is suitable for a reversible key including a single pair of operative element, e.g. key 1000 (FIGS. 1A and 1B).

Figure 9A:
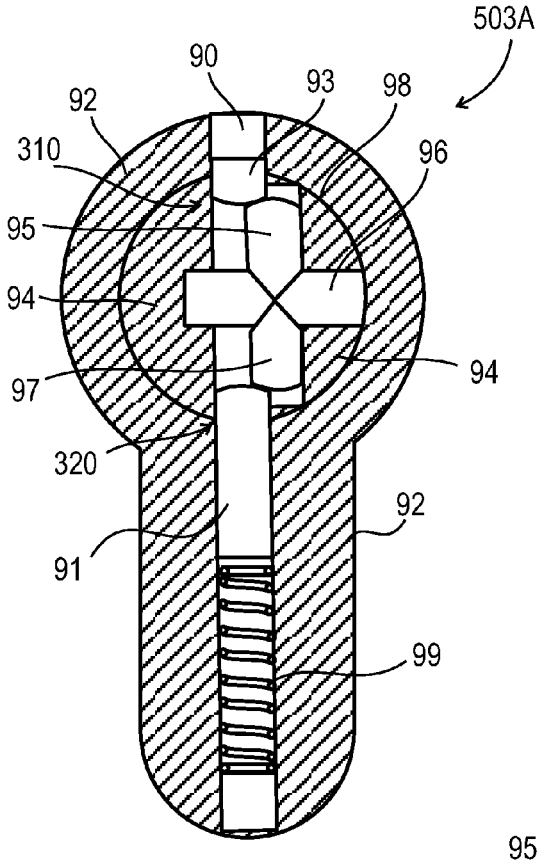
FIGS. 9A and 9B are cross-sectional schematic views of two exemplary cylinder locks including an off centered key pin and centered driving pin in a locked position in accordance with some embodiments of the present invention.
Figure 9B:
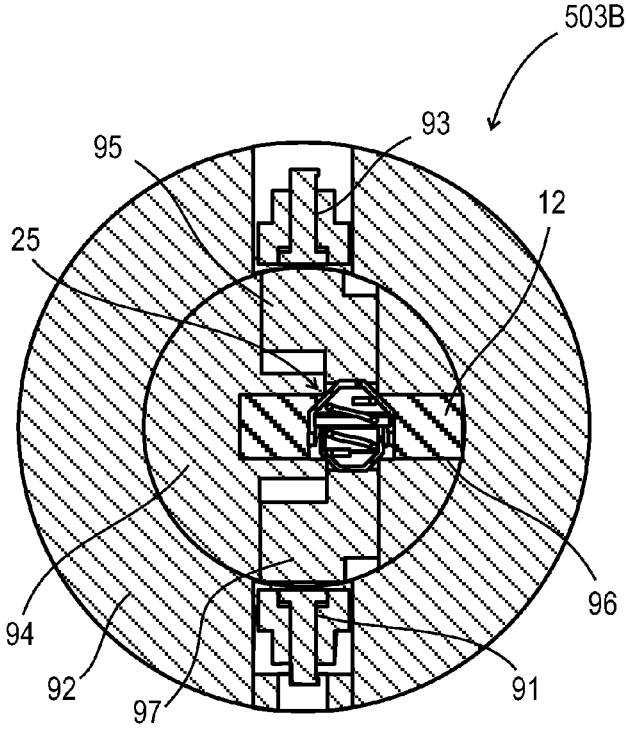

FIGS. 9A and 9B show a cross-sectional schematic view of two exemplary cylinder locks including an off centered key pin and centered driving pin in a locked position shown in a locked position and while engaging with coaxial pair of operative elements of a key in accordance with some embodiments of the present invention. According to some embodiments of the present invention, a reversible arrangement of a pair of coaxial elements as shown in FIGS. 1A and 1B can be operated with exemplary cylinder locks 503A and/or 503B. According to some embodiments of the present invention, cylinder locks 503A and 503B provide key pins 95 and 97 that are off centered with respect to corresponding driving pins 93 and 91 but that operatively engage a pair of operative elements 25 centered with respect to keyway 96. In some exemplary embodiments, the setup exemplified in FIGS. 9A and 9B provide for centering the pair of coaxial elements 25 along a width of shaft 12 so that reversibility is provided with a single pair of coaxial elements while a portion of the lock pin mechanism embedded in the housing, e.g. the driving pins, is maintained in a standard configuration, e.g. centered within the housing of the cylinder. Optionally, the size and shape of key pins 95 and 97 may be altered to match (or accommodate) different sizes, shapes and/or positions of coaxial elements 25 on various keys while the structure of driving pins 93 and 91 may be maintained.

Figure 10:
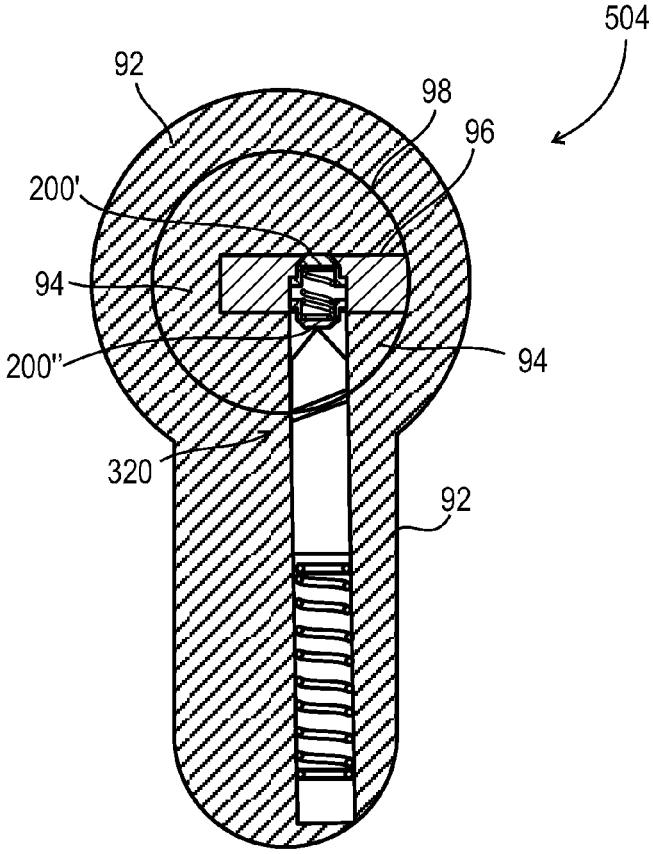
FIG. 10 is a cross-sectional schematic view of a cylinder lock including one locking pin mechanism in operative engagement with one of a pair of operative elements of a key in accordance with some embodiments of the present invention.

Reference is now made to FIG. 10 showing a cross-sectional schematic view of a cylinder lock including one pin mechanism in operative engagement with one operative element of a pair of operative elements of a key in accordance with some embodiments of the present invention. According to some embodiments of the present invention a cylinder lock 504 includes a pin mechanism 320 engaging only one of the two operative elements of a key shaft 12, e.g. element 200" of key 100, inserted in keyway 96. In this case, the pair of coaxial elements provides for a reversible key so that any one of the operating elements on the key may be engaged depending on which direction the key is inserted while the other will not be in operable engagement with a pin mechanism. By reversing the key, element 200' will engage pin mechanism 320 while element 200" will not be in operable engagement with a pin mechanism, e.g. will not be operable.

Figure 11A:
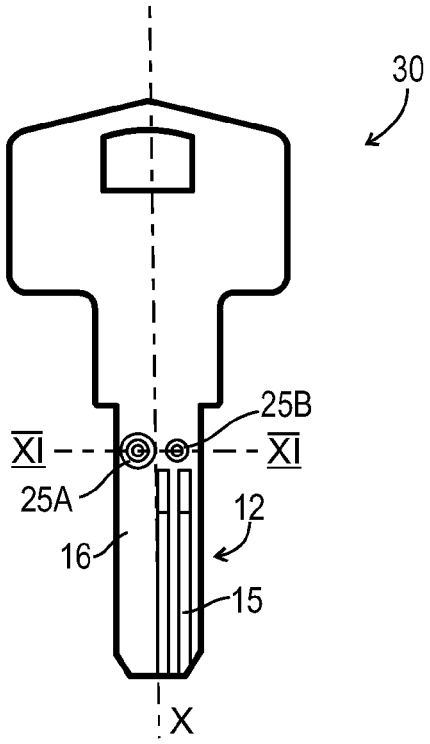
FIGS. 11A and 11B are schematic illustrations of exemplary key blanks including two coaxial pairs of operative elements in accordance with some embodiments of the present invention.
Figure 11B:
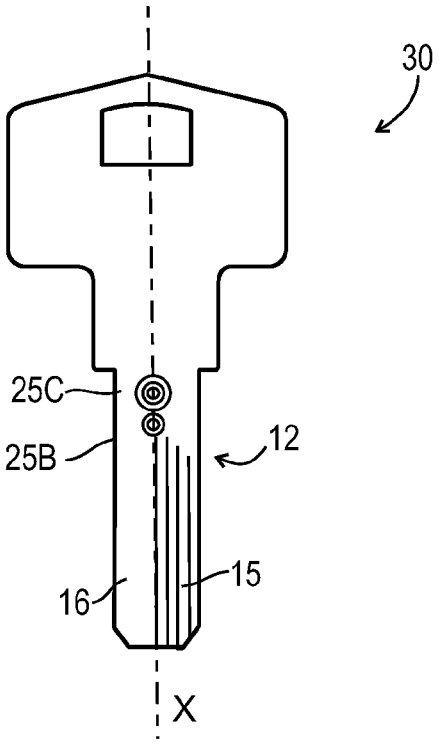

Reference is now made to FIGS. 11A and 11B showing schematic illustrations of exemplary key blanks including two coaxial pairs of operative elements in accordance with some embodiments of the present invention. According to some embodiments of the present invention more than one pair of coaxial operating elements may be included in a single key blank. In some exemplary embodiments, including additional pairs of coaxial operating elements provides for increasing the security possible by providing different key and lock combinations. In some exemplary embodiments, adding additional pairs of coaxial elements also provides for making the key reversible. In some exemplary embodiments, coaxial elements 25A and 25B are spaced apart along a width of a shaft 12 (FIG. 11A). Optionally, when both pairs of coaxial elements are identical in structure and are positioned symmetrically with respect to a longitudinal axis X of shaft 12, key 30 can be reversible. Optionally, additional pairs of coaxial elements, e.g. coaxial elements 25C and 25D are spaced apart along the longitudinal axis of the shaft as shown in FIG. 11B. Optionally, in a case when both coaxial elements 25C and 25D are positioned along an axis X, key 30 can be reversible (FIG. 11B).

Figure 12A:
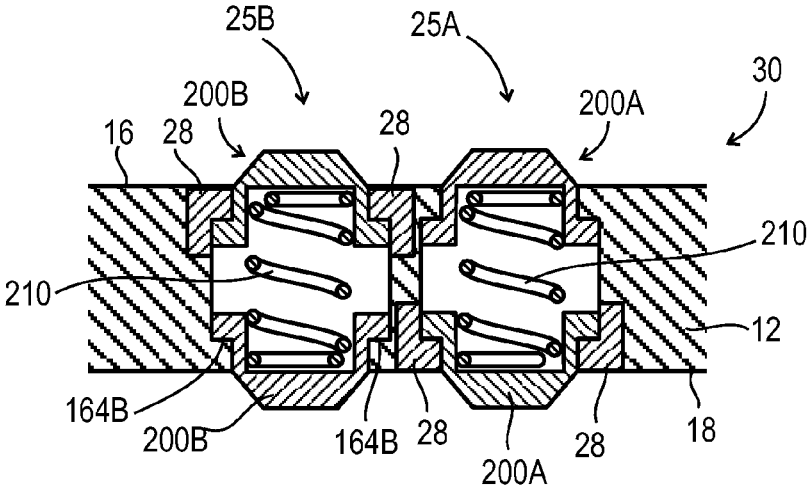
FIGS. 12A-12C are enlarged cross-sectional schematic views of exemplary coaxial pairs of operative elements along line XI-XI of FIG. 11A in accordance with some embodiments of the present invention.
Figure 12B:
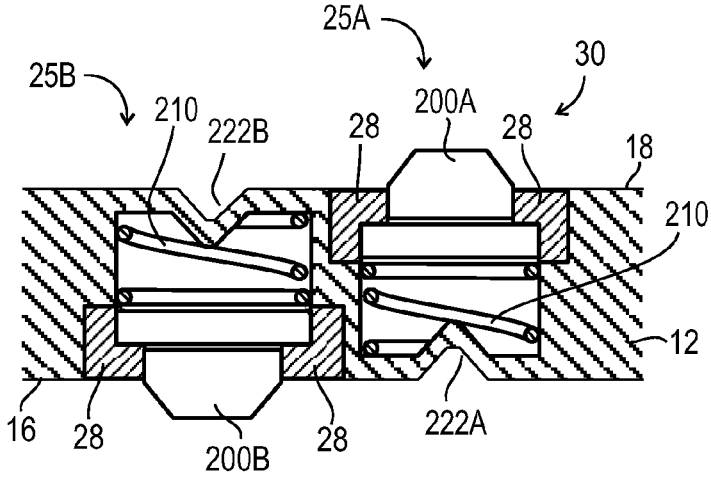
Figure 12C:
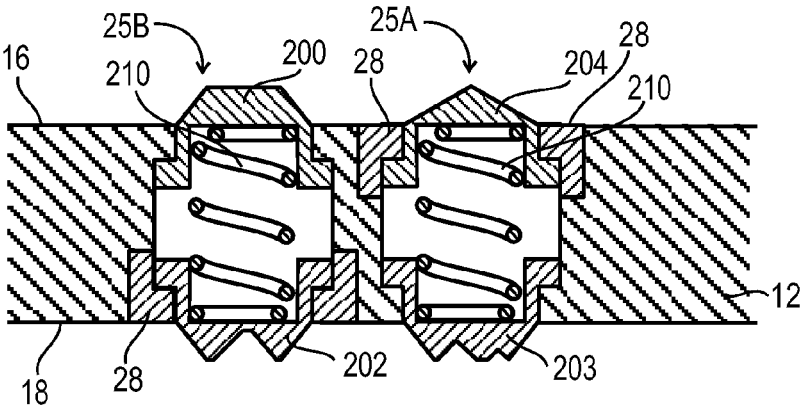

Reference is now made to FIGS. 12A-12C showing enlarged cross-sectional schematic views of exemplary coaxial pairs of operative elements along line XI-XI of FIG. 11A in accordance with some embodiments of the present invention. In some exemplary embodiments each of the operative elements of pair 25A and 25B are identical (FIG. 12A) and thereby key 30 can be reversible when the pairs are symmetrically aligned along the width of shaft 12. Optionally, oppositely facing operative elements of different pairs are identical and the key 30 can still be reversible. For example as shown in FIG. 12B, each of coaxial pair 25A and 25B include one operating element 222 and one operating element 200 but on opposite surfaces of shaft 12. Optionally, key 30 is not designed to be reversible and each of the operating elements can be unique, e.g. operating elements 200, 202, 203, and 204 in FIG. 12C. Thus, the number of different key and lock combinations for resilient elements can be increased and the difficulty in picking such a lock is also increased.

According to some embodiments of the present invention, assembly of the two pairs of coaxial elements is similar to the methods described in reference to FIGS. 3, 4A-4B and/or FIG. 5A-5B. Typically, each of the two pairs is assembled from opposite surfaces of key shaft 12. For example, coaxial pair 25B may be inserted from surface 16 and held within the shaft by step 164B on one end and sealed from surface 16 by a sealing element 28 from the other end. Coaxial pair 25A may be inserted from surface 18 and sealed from surface 16.

Figure 13:
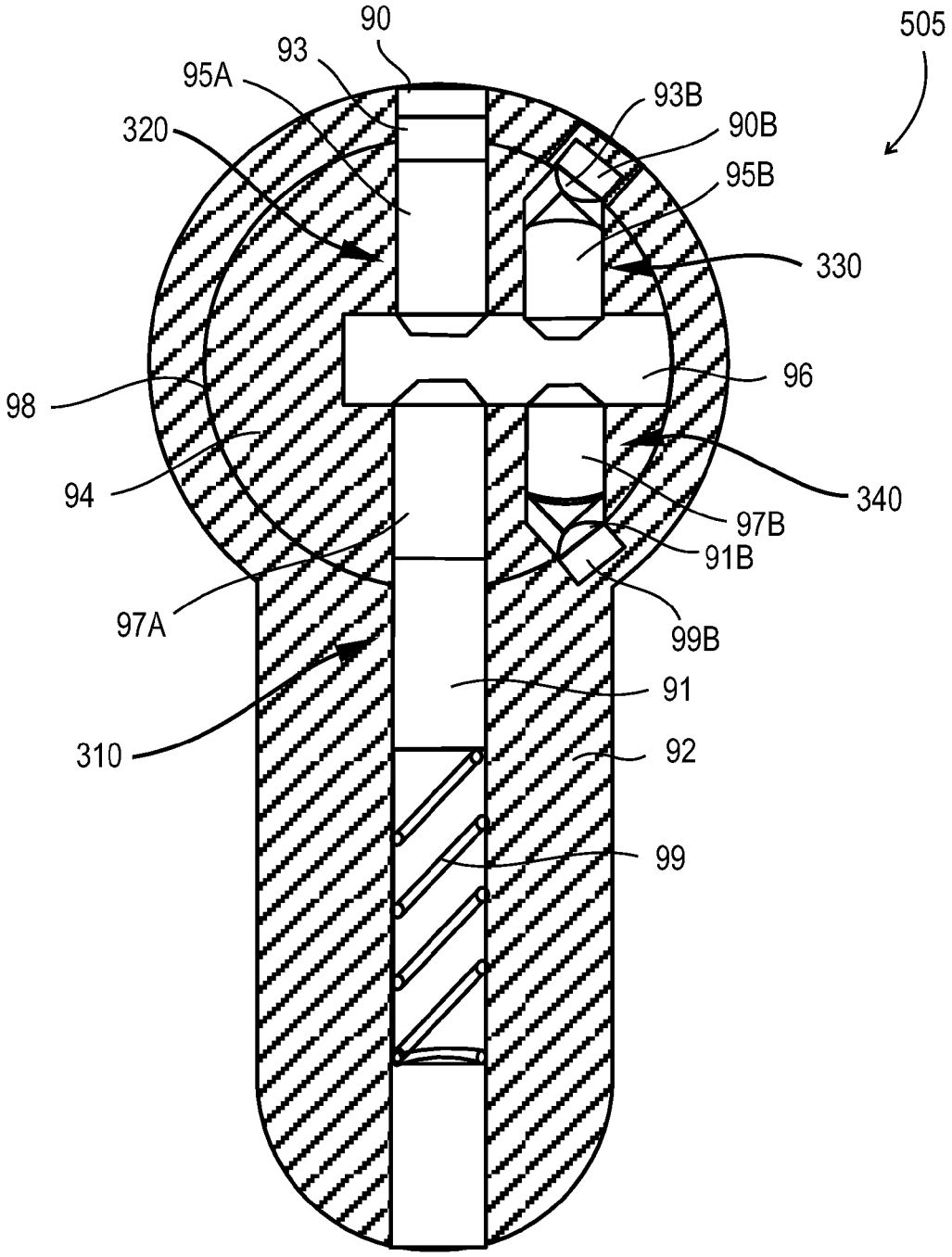
FIG. 13 is a cross-sectional schematic view of a cylinder lock with four lock pin mechanisms suitable for operable engagement with two coaxial pairs of operative elements of a key in accordance with some embodiments of the present invention.

FIG. 13 shows a cross-sectional schematic view of a cylinder lock with four lock pin mechanisms suitable for operable engagement with two coaxial pairs of operative elements of a key in accordance with some embodiments of the present invention. According to some embodiments of the present invention, lock 505 includes four lock pin mechanisms operative to engage each of the four operating elements of key 30. Typically, the four locking pin mechanisms are composed from two pairs of coaxial lock pin mechanisms aligned with the two pairs of coaxial operating elements. Typically, each locking pin mechanism includes a key pin, e.g. 95A, 95B, 97A, 97B, a driving pin, e.g. 93A, 93B, 91A, 91B respectively, and a spring element, e.g. 90A, 90B, 99A, 99B respectively. According to some embodiments of the present invention, only when all four pin mechanism clear the shear line 98, shaft 94 can be rotated so that each of the four operating elements have to match each of the four locking pin mechanisms to unlock lock 504.

Figure 14A:
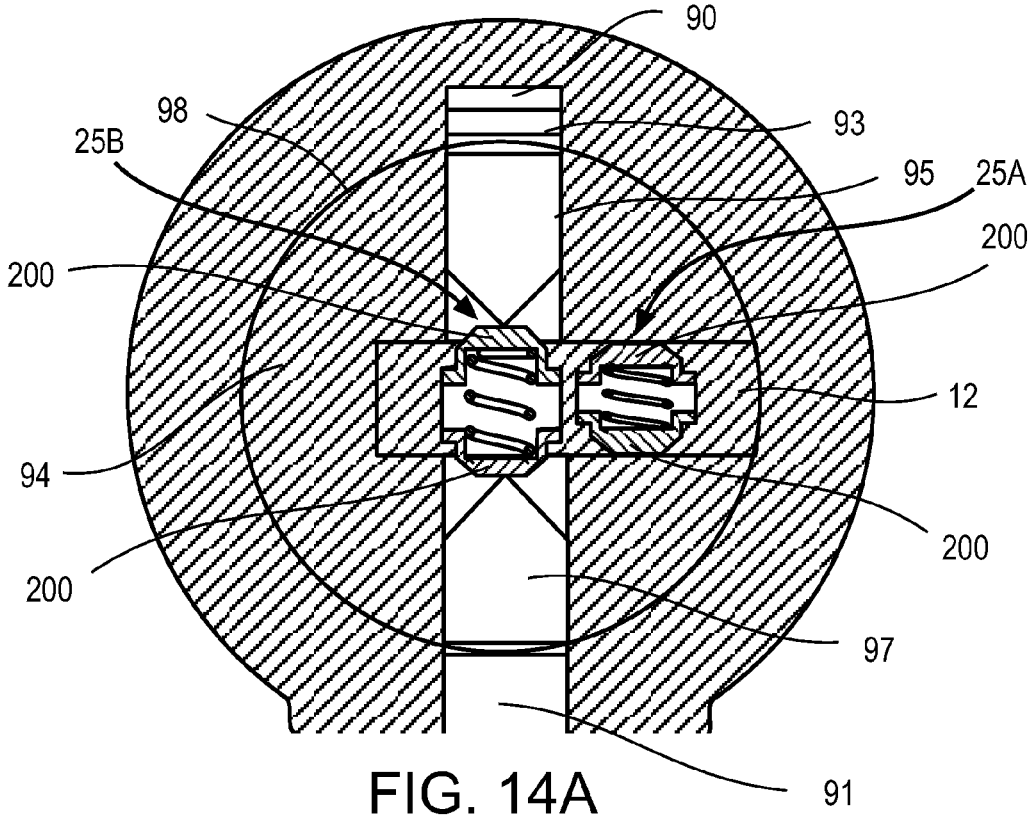
FIGS. 14A-14B are cross-sectional schematic views of a plug of a cylinder lock including one pair of locking pin mechanisms operated with a reversible key including two coaxial pairs of operative elements positioned along the key shaft width in accordance with some embodiments of the present invention.
Figure 14B:
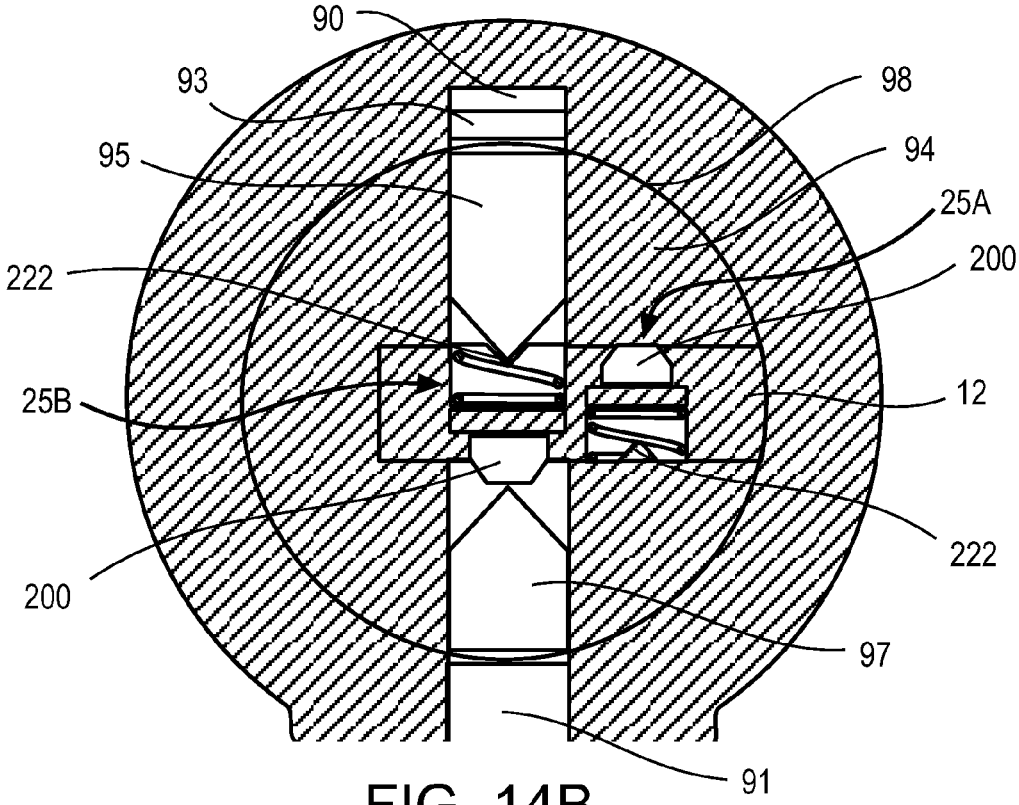

Reference is now made to FIGS. 14A-14B showing cross-sectional schematic views of a plug of a cylinder lock including one pair of locking pin mechanisms operated with a reversible key including two coaxial pairs of operative elements positioned along the key shaft width in accordance with some embodiments of the present invention. According to some embodiments of the present invention, less than all the operating elements on a key is operatively engaged to locking pin mechanisms in the lock to provide for unlocking the lock (or elements of the lock). According to some embodiments of the present invention, only one pair of coaxial elements 25B is operative to engage the locking pin mechanisms and release the lock while the other pair of coaxial elements 25A is not operable. However, when reversing the key, pair 25A will be operative to engage the locking pin mechanism and pair 25B will not inoperable. While a pair of coaxial element is not operatively engaged the protruding elements of the pair are depressed to fit into keyway 96 and do not obstruct operation of the lock. Optionally, locking pin mechanism including key pin 95, driving pin 93 and spring element 90 is not required.

Figure 15A:
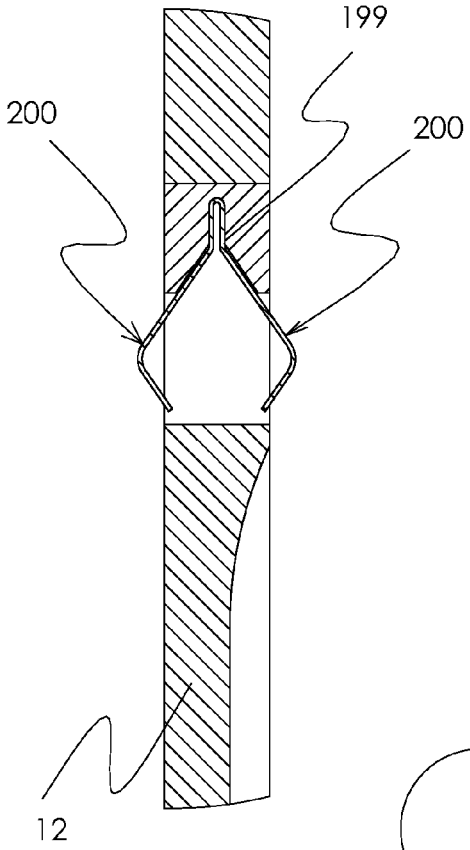
FIGS. 15A-15C are schematic illustrations of exemplary key blanks, each including a coaxial pair of operative elements composed from a resilient element in accordance with some embodiments of the present invention.
Figure 15B:
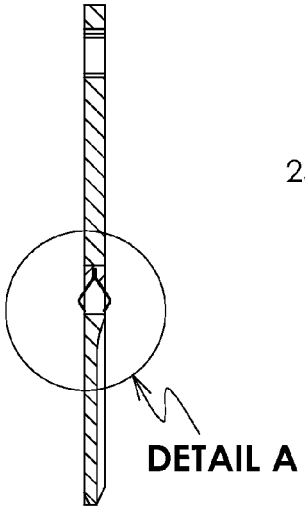
Figure 15C:
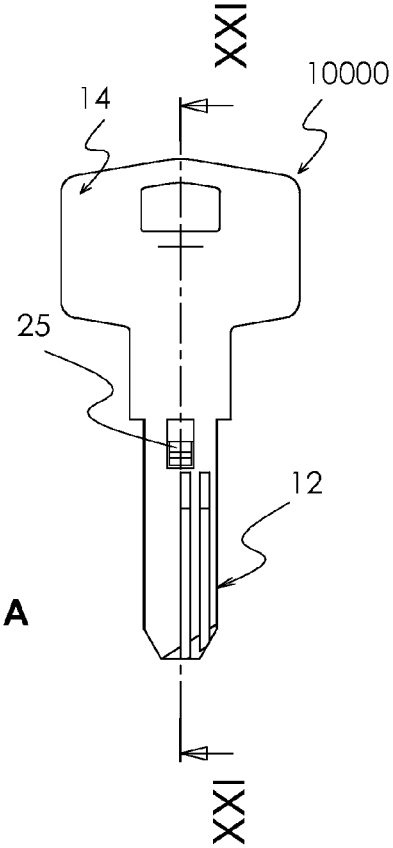

Reference is now made to FIGS. 15A-15C schematic illustrations of exemplary key blanks, each including a coaxial pair of operative elements composed from a resilient element in accordance with some embodiments of the present invention. According to some embodiments of the present invention, operative elements 200 are spring elements, e.g. leaf spring elements. In some exemplary embodiments, one portion 199 of spring element 200 is fixed, e.g. non-rotatably fixed into shaft 12. Operative portion 200 protrudes from shaft 12 while no compressive force is exerted on it and is recedes into shaft 12 in response to a compressive force exerted on it. It is noted that although spring leaf 200 is shown as one element, each of coaxial operative elements 200 can alternatively be formed from separate spring elements.

The terms "comprises", "comprising", "includes", "including", "having" and their conjugates mean "including but not limited to".

The term "consisting of means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

KEY FOR THE DRAWINGS

10, 100, 1000 key with one pair of coaxial operating elements
12 key shaft
14 key head
15 key guide lines
16, 18 opposite surfaces of key shaft
20 through going hole
25 coaxial pair of operating elements on key
28 sealing ring
30 key with two pairs of coaxial operating elements
90 spring
91 locking pin in housing of cylinder
92 housing of cylinder
93 locking pin in housing of cylinder
94 cylinder plug
95 pin engaging key operating elements
96 keyway
97 pin engaging key operating elements
98 shear line of cylinder
99 spring
164 notch

200-204 push-pins with different geometries
210 spring element providing resilient force on push pins
221 wall on which flange 224 of push-pins slides
222 an indented operating element that is not spring loaded
224 flange (step)
250 capsule including coaxial pair of operating elements
310, 320, 330, 340 locking pin mechanisms
500-505 cylinder locks

What we claimed is:

1. A key blank comprising:

a shaft and a head connected to the shaft, the shaft including first and second surfaces that are oppositely facing, wherein the surfaces are configured to include operating elements to operate a lock; and a pair of coaxial operating elements mounted inside a bore provided in the shaft, wherein the first operating element of the pair is a resilient element that protrudes from the first surface of the shaft to its full extent whenever no force is exerted on the first operating element and retracts toward the first surface responsive to force exerted on the first operating element and the second operating element of the pair is a resilient element that protrudes from the second surface of the shaft to its full extent whenever no force is exerted on the second operating element and retracts toward the second surface responsive to force exerted on it, and wherein each of the coaxial operating elements is adapted to assume one of the protruding and retracting positions independently from the corresponding position assumed by the other coaxial operating element.

2. The key blank according to claim 1, wherein both the operating elements of the pair are spring loaded with a common spring element.

3. The key blank according to claim 1, wherein the operating elements are telescopic with respect to each other.

4. The key blank according to claim 1, wherein the pair of coaxial operating elements is centered with respect to a central axis of a matching lock.

5. The key blank according to claim 1, wherein at least one of the operating elements of the pair includes an indentation to operatively engage a pin mechanism of the lock to release the pin mechanism from the locked position.

6. The key blank according to claim 1, wherein the operating elements of the pair are different in size shape or both.

7. The key blank according to claim 1, wherein the pair of coaxial operating elements is pre-assembled in a form of a capsule.

8. The key blank according to claim 1, wherein the key blank includes only one pair of coaxial operating elements and wherein the one pair of the coaxial operating elements is positioned on the key blank in a manner that provides for making a reversible key.

9. The key blank according to claim 1, wherein the axis common to the pair of coaxial operating elements is perpendicular to the first and second surface of the shaft.

10. The key blank according to claim 1, comprising two pairs of coaxial operating elements.

11. The key blank according to claim 10, wherein the two pairs of coaxial operating elements are positioned symmetrically with respect to a longitudinal axis of the shaft.

12. The key blank according to claim 10, wherein the two pairs of coaxial operating elements are operative to engage four different pin mechanisms in the lock.

13. A cylinder lock operable by a key blank according to claim 1, the lock comprising:

a housing;

a plug disposed within the housing configured for rotation relative thereto and defining a keyway and a circumferential shear line; and a pair of coaxial spring loaded pin mechanisms positioned on opposite sides of the keyway, wherein each of the pin mechanisms extends from the housing through the plug so as to obstruct the shear line;

wherein each of the pin mechanisms is operative to retract into the housing and thereby clears the shear line in response to a spring loaded force exerted by one operating element of the pair of coaxial operating elements.

14. The cylinder lock according to claim 13, wherein a spring loaded force of the pin mechanism included in the lock is less than the spring loaded force exerted by the one operating element.

15. The cylinder lock according to claim 13, wherein the pin mechanism includes a key pin and a driving pin in operative engagement, and wherein the driving pin is centered with respect to the housing and off centered with respect to the key pin.

16. The cylinder lock according to claim 15, wherein the key pin is configured to move from a position within the keyway of the lock to a position out of the keyway of the lock in response to operative engagement with an operating element of the key blank.

17. The key blank according to claim 1, wherein each operating element of the pair of coaxial operating elements is operative to engage a different pin mechanism in the lock.

18. The key blank according to claim 1, wherein the pair of coaxial operating elements is operable to provide a bi-directional force in response to operative engagement with a corresponding pair of pin mechanisms in a lock.

19. The key blank according to claim 1, wherein each of the coaxial operating elements is adapted to operate independently from the other of the pair.

20. The key blank according to claim 1, wherein each of the coaxial operating elements is adapted to exert a compressive force on one of a pair of pin mechanisms of the lock in response to operative engagement with the pair of pin mechanisms and thereby release the pair of pin mechanisms from a locked position of the lock, each pin mechanism of the pair released without requiring any pressure on the coaxial element protruding from the opposite surface of the shaft.

21. The key blank according to claim 1, wherein both the first and second operating elements together protrude to their full extent whenever no force is applied on the first and second operating elements.

22. A method of manufacturing a key blank, the method comprising:

forming a through going bore through opposite surfaces of a shaft of a key blank;

positioning a pair of coaxial resilient operating elements into the through going bore, wherein each operating element of the pair faces an opposite surface of the shaft and wherein each operating element of the pair is adapted to protrude to its full extent whenever no pressure is applied on it; and protruding at least a portion of each of the operating elements within the shaft from an opposite surface of the shaft to an extent that provides operative engagement with the at least one pin mechanism of a matching lock without requiring any pressure on the coaxial element facing the opposite surface.

23. The method according to claim 22, comprising positioning a spring element between the pair of coaxial operating elements.

24. The method according to claim 22, wherein each of the operating elements is selected to provide a spring force that is greater than a spring force provided by at least one pin mechanism of the matching lock.

25. The method according to claim 22 comprising retaining the pair of coaxial operating elements with a sealing ring positioned around one of the pair of coaxial operating elements.

26. The method according to claim 22, wherein the pair of coaxial operating elements is pre-packaged in capsule form.

27. The method according to claim 22, wherein each operating element of the pair operates independently from the other of the pair to exert a compressive force on at least one pin mechanism of the lock.

28. The method of according to claim 22, wherein each operating element of the pair faces an opposite surface of the shaft and is operative to apply pressure on one of a pair of pin mechanisms of a matching lock so that each pin mechanism of the pair can be released without any pressure applied on the coaxial element protruding from the opposite surface of the shaft.

29. The method of claim 22, wherein each operating element of the pair is adapted to move only in response to pressure applied on the operating element.

* * * * *